United States Patent [19]

Holland

[11] Patent Number: 4,538,808

[45] Date of Patent: Sep. 3, 1985

[54] DEVICE FOR TRAINING BASKETBALL PLAYERS TO SHOOT

[76] Inventor: Hugh H. Holland, 201 W. South Third, Shelbyville, Ill. 62565

[21] Appl. No.: 586,340

[22] Filed: Mar. 5, 1984

[51] Int. Cl.[3] ..... A63B 69/00

[52] U.S. Cl. ..... 273/1.5 A; 49/34

[58] Field of Search ..... 273/1.5 A, 55 R; 49/9, 49/34

[56] References Cited

U.S. PATENT DOCUMENTS

| | | | |
|---|---|---|---|
| 2,153,384 | 4/1939 | Mazza | 273/55 R |
| 2,874,493 | 2/1959 | Mandel | 49/34 |
| 3,451,677 | 6/1969 | Nedwick | 273/55 R |
| 3,552,749 | 1/1971 | Piggotte | 273/1.5 A |
| 4,227,344 | 10/1980 | Poppke | 49/34 X |

*Primary Examiner*—Paul E. Shapiro
*Attorney, Agent, or Firm*—Kalish & Gilster

[57] ABSTRACT

A device for training basketball players to shoot while being in contact with or resisted by the arms of others includes a cage of tubular framework defining an opening through which a basketball player must enter the cage for shooting the ball from a shooting position within the cage. Pairs of arm-simulative members extend inwardly from opposite sides of the cage, each being of elongated arm-shaped character and affixed at a proximal end to the cage in forcibly yieldable relationship; such members are relatively positioned for being contacted by the player during movement to the shooting position.

5 Claims, 9 Drawing Figures

DEVICE FOR TRAINING BASKETBALL PLAYERS TO SHOOT

BACKGROUND AND SUMMARY OF THE INVENTION

This invention relates to training devices for athletes and more particularly to a device for training basketball players to shoot the basketball under conditions simulative of contact with or being resisted by the arms of other players.

Basketball, always an agressive, fast-moving game, has in recent years become literally a contact sport wherein opposing players often interpose physical resistance to the shooting of the ball by the ball carrier in blocking the shot by their arms. This often results in the body of the shooter being forcibly contacted by the arms of the other players, whether deliberately or inadvertently. Because of this contact element, basketball has turned into a game of power. Players, particularly young players, can become skillful in their ball handling skills and shooting, yet if they lack the ability of being able to play with such increased body contact, they will be very limited in their development within the sport.

A need exists for apparatus which will enable players to practice contact and to develop finess in shooting the basketball under conditions simulative of the actual resistance and body contact which they will be expected to encounter during actual play.

It is an object of the invention to provide a device for simulating the resistance to a basketball shooter which will be encountered when in contact with and resisted by the arms of other players.

It is also an object of the invention to provide such a device for enabling basketball players to practice contact with other players while moving to the shooting position.

Another object of the invention is to provide such a device which enables basketball players to develop ball handling skill; to develop contact consciousness; to practice and simulate body contact whether with or without the basketball; and which allows the player to practice completion of "three-point" play or of being fouled in the act of shooting.

It is also an object of the invention to provide such a device which develops in the player an ability to "shoot in a crowd" even when other players are not available for scrimaging, as well as providing a device which teaches the player to go straight up when shooting.

Additionally, it is an object of the invention to provide such a device which is readily assembled of relatively few, economical parts, which can be taken apart and stored in knocked-down condition, and which can be readily transported as during practice at a distant location.

Further, it is an object of the invention to provide such a device which is entirely safe and durable during normal usage, being configured with parts which may be safely contacted by the player without fear of injury.

Additionally, it is an object of the invention to provide such a device to which can be added auxiliary arm-simulative elements thereby to alter its capability of simulating resistance of the arms of other players at different heights while shooting.

Briefly, a device of the present invention for training basketball players to shoot while being resisted by the arms of other players includes a so-called trap, formed of a tubular framework, for defining an opening rearwardly of the cage through which a basketball player (with or without a ball) must enter the cage for shooting the basketball from a shooting position within the cage. The cage has two side frames each carrying a plurality of arm-simulative, elongated members which extend inwardly of the cage from its opposite sides, i.e., from the frame members. The arm-simulative members resist movement of the player to a shooting position. Such members are each of elongated tubular character and are affixed at their proximal ends in forcibly yieldable relationship to the cage. They are positioned for being contacted during movement by the player to the shooting position, thereby requiring the player forcibly to cause yielding of the members during such movement.

Other objects and features will be in part apparent and in part pointed out hereinbelow.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
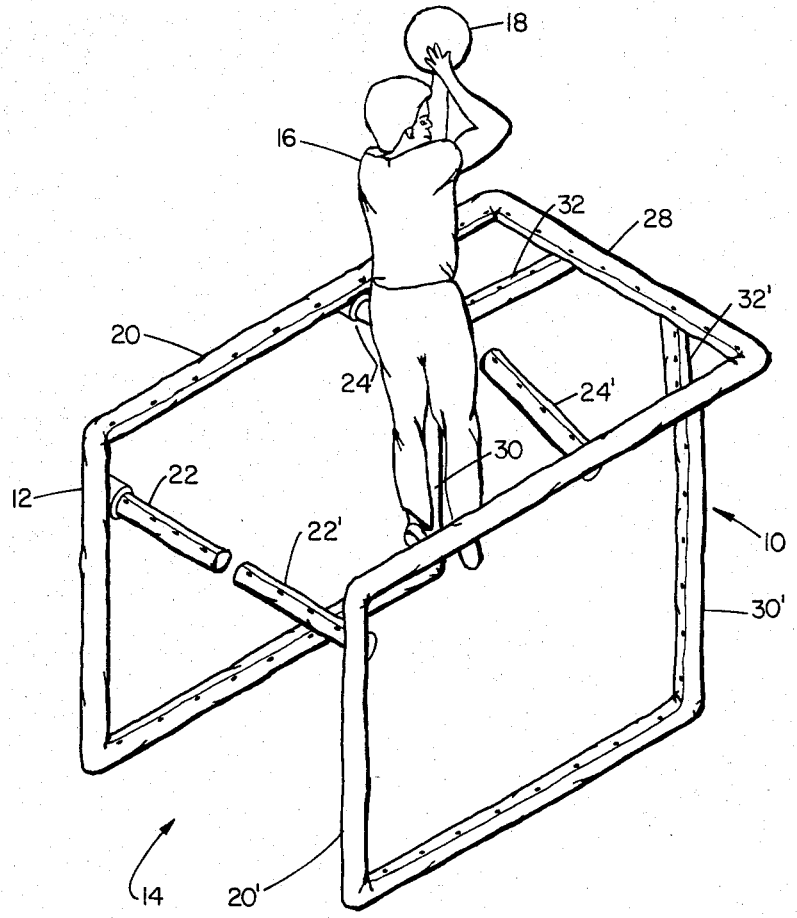
FIG. 1 is a perspective view of a basketball training device in accordance with and embodying the present invention, and illustrating the use thereof by a basketball player.

Referring now to the drawings by reference numerals, there is generally indicated at 10 a device of the present invention for training basketball players to shoot while being in contact with or resisted by the arms of other players. Device 10 defines what is referred to as a trap or cage 12 having an opening 14 at the rear thereof through which a player 16 enters, with or without a basketball 18 for shooting the ball from a shooting position, as illustrated, from within cage 12.

The cage is defined of framework having two side frames 20, 20' from which extend inwardly pairs of arm-simulative members 22, 22' and 24, 24' which are each of arm-shaped character and affixed to the side frame members 20, 20' at their proximal ends in forcibly yieldable relationship to cage 12.

Thus, in the configuration shown, the first pair of such arm members 22, 22' are located proximate opening 14 for being contacted by the player to resist his movement into cage 12 and to the shooting position illustrated, while the other pair of arm members 24, 24' are located well into the cage and supported at a higher level than arms 22, 22′ so as to be forcibly contacted by the player only when he is jumping to the shooting position.

Such arm members 22, 22′ and 24, 24′ are thus simulative of the arms of other players. Since they are resiliently supported and carried by cage 12, they will flex and be caused to swing from their normal, opposed, aligned relationship relative to one another by the force of the player's body during the shooting movement. The resilience is sufficiently great that the arm members require the player forcibly to cause them to yield in moving to the shooting position within cage 12, as shown in FIG. 1.

Figure 2:
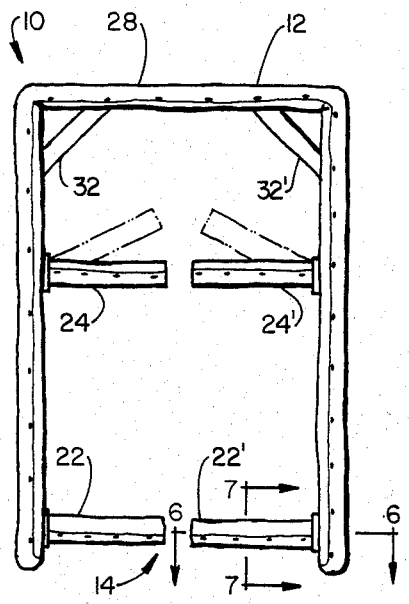
FIG. 2 is a top plan view thereof.
Figure 3:
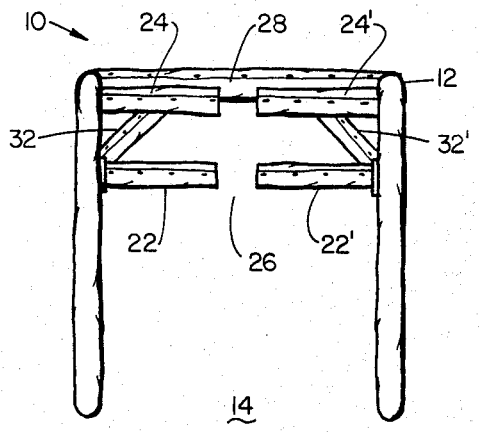
FIG. 3 is a rear elevational view thereof.

As will be apparent from FIGS. 2 and 3, the distal ends of such members 22, 22′ and 24, 24′ are in opposed, aligned relationship and separated by a narrow space, as at 26, for example, insufficient for permitting the player to pass through it without forcibly displacing the arms, and such displacement is shown in FIG. 1 for the forward set of arms 24, 24′ and in FIG. 2 as well by dashed lines.

Figure 4:
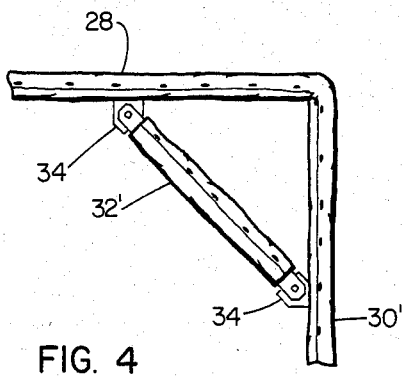
FIG. 4 is a fragmentary view illustrating a brace arrangement of the trainer.

Side frames 20, 20′ are each of rectangular configuration, being formed of steel tubing in the form of a single loop or square which is joined across the front of the cage 12 by a single horizontal member 28 braced to upright members 30, 30′ by diagonal braces 32, 32′ each comprising a single length of tubing affixed by brackets (see FIG. 4) as at 34 attached to member 28 and the upright frame member, as at 30′.

Figure 7:
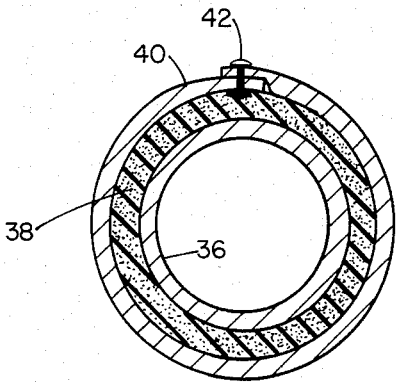
FIG. 7 is a lateral cross section, even more greatly enlarged, as taken generally along line 7—7 of FIG. 2.

All such tubular members are protectively covered to prevent injury of a player by contacting portions of device 10. Thus, referring to FIG. 7, a portion 36 of a tubular member of cage 12 is shown in cross section, being surrounded by a layer 38 of foam, padding material rubber or other soft poromeric material which is, in turn, enclosed by a cover 40 of vinyl or other suitable washable, waterproof material preferrably closed as by snaps 42 at intervals along the tubular members.

Figure 5:
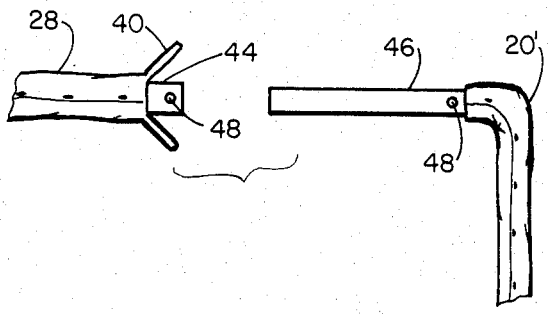
FIG. 5 is a fragmentary view of tubular members of a framework of the device, illustrating the interconnection of such tubular members.

As shown in FIG. 5, the tubular construction permits disassembly of cage 12 into component portions, as for storage, transportation and erection at a different location. For this purpose, horizontal member 28 is preferrably joined in its ends, as at 44 to the side frame members such as those portions of side frame 20′ shown therein, including a horizontal tubular extension 46 of smaller diameter then portion 44, for telescopically being fitted within the latter and bolted together as by bolts fitted through aligning bolt holes 48. The horizontal braces 32, 32′ may readily be bolted or unbolted to the brackets 34 at opposite ends. Cover 40 is shown peeled back from the end portion 44 of member 28 to reveal the securement and provide access to the bolt holes 48 and permitting the bolts or other fasteners to be covered protectively when the unit is assembled. Lateral member 28 maintains side frames 20, 20′ vertical in spaced, parallel relationship.

The resultant cage construction is rugged and reliable and poses no intervening structure at the rear opening 14 which would interfere with the movement of the player 16 into the cage or with dribbling or handling of the ball.

Figure 6:
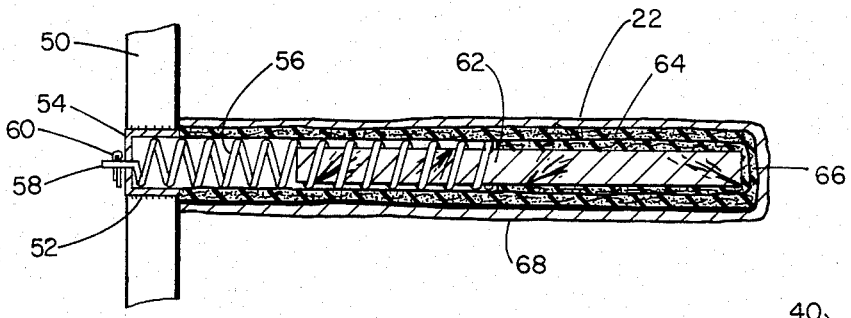
FIG. 6 is an enlarged longitudinal cross section of an arm simulative member of the invention, as taken generally along line 6—6 of FIG. 2.

The construction of each arm member, such as that designated at 22, is shown in cross section in FIG. 6. There, a vertical member of one of the side frames is designated representatively at 50, having welded to it a sleeve or collar 52 of cylindrical shape closed at one end 54. The arm simulative member 22 includes a coil spring 56 having at an inner end a short axial extension 58 which extends through the small aperture in the end 54 of the collar and which extension may be pinned in place by a cotter pin or other securement means fitted through a small aperture in the spring extension. According to the invention, coil spring 56 may extend throughout the entire length of the arm simulative member or more preferrably over only a portion, as shown. In the illustrated construction, there is fitted within the inside diameter of spring 56 a dowel rod 62, as by friction fit, to reduce the resilience of the arm member 22 in its outer portion. One or more layers 64 of foam, rubber or other soft poromeric material surround coil spring 56 and dowel rod 62, being extended over the end of dowel rod 62 as at 66 for padding the end of the arm member. A cover 68 as secured at intervals along its length by snaps 42, is fitted over the padding material.

Such arm member construction provides a rod-like projection which the player will be compelled to contact forcibly, in order to displace it against the tendency of the spring 56 to maintain the arm member in horizontal, straight orientation, thereby providing a realistic simulation of the type of pressure and action which the player would experience in contacting the outstretched arms of other players during actual play.

Figure 8:
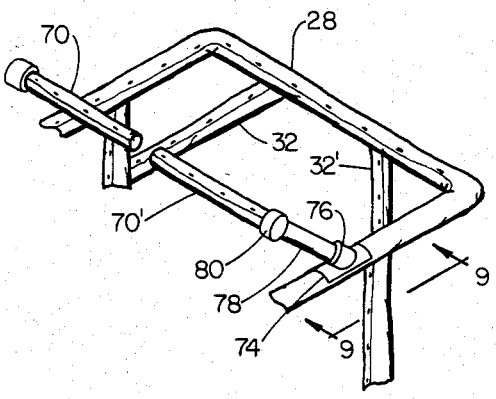
FIG. 8 is a fragmentary perspective view illustrating the addition to the device of auxiliary arm-simulative members.

Although arms 24, 24′ will be contacted by the lower part of the players body, i.e., the torso in jumping to the shooting position of FIG. 1, additional resistance during shooting may be provided by the addition of further arm-simulative members, as shown in FIG. 8, which are to be contacted by the arms or shoulders of the player when shooting.

Figure 9:
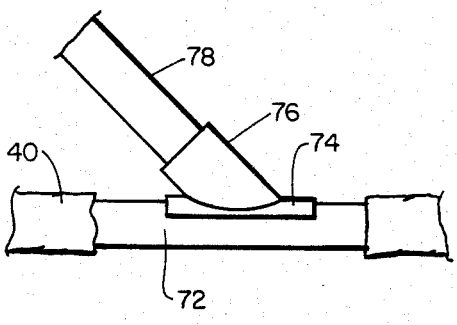
FIG. 9 is a fragmentary side elevation, as taken generally along line 9—9 of FIG. 8, illustrating features for securement of the auxiliary arm-simulative members.

Such additional arms are designated at 70, 70′ and may be added as accessories to device 10, preferrably being so located when added as to be precisely or approximately immediately above and vertically aligned with members 24, 24′. Their method of securement and attachment is illustrated in FIG. 9, wherein a horizontal tubular member 72 is fragmentarily shown, its padding material and cover 40 being peeled back to reveal a partial sleeve 74 which is welded, pinned or bolted or otherwise suitably secured to member 72. Said sleeve 74 carries a collar extension 76 for receiving a tubular member 78 which extends rearwardly therefrom at approximately a 45° angle to a fitting 80 for receiving the respective arm-simulative member 70, 70′. Said fitting 80 may be of the type of closed-end collar such as designated at 52 in FIG. 6, if desired.

Device 10 can be easily located at any desired position upon the basketball court. Although it is not illustrated with wheels, device 10 may be equipped with wheels or casters at one end or both to facilitate movement. Further, although it is closed on one end, device 10 may be configured to allow a player to enter from one end and exit at the other, as for dribbling through to simulate the interference from other players. Also, usage may be reversed from that described. That is, the player may start from inside the device and dribble or otherwise move from within the device to simulate arm interference from a fixed position.

Accordingly, it will be apparent that the arm members 22, 22′ guarding entrance 12 necessarily must be of sufficient height to permit the player to dribble in or out of cage 12.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A basketball training device for training basketball players to shoot while contacted or resisted by the arms of other players comprising a framework defining a cage and an opening into the cage, the cage being of sufficient dimensions for allowing a player therein to shoot from the cage, the framework carrying first and second pairs of resilient, forcibly yieldable arm-simulative members, the first pair of arm-simulative members extending inwardly toward one another from opposite sides of the entrance at a height sufficient for permitting the player to dribble a basketball through the opening, but sufficiently blocking the entrance as to resist the player in forcibly yieldable relationship in moving through the entrance, the second pair of arm-simulative members extending inwardly of the cage toward one another from opposite sides of the cage but displaced horizontally from, and vertically located at a greater height than, the first pair of arm-simulative members for resisting the player in forcibly yieldable relationship when jumping to the shooting position, whereby the training device is simulative of arm resistance and body contact during actual basketball play, the framework being formed of side frames defining the sides of the cage, the side frames being joined together only by a horizontal member extending across the entrance-remote end of the cage, whereby there is no intervening structure for interfering during movement of the player relative to the cage or with dribbling or handling of the basketball.

2. A basketball training device according to claim 1 wherein the side frames and horizontal members define a generally U-shaped plan configuration of the cage.

3. A basketball training device according to claim 1 and further comprising a third set of arm-simulative members extending inwardly of the cage from opposite sides of the cage and located above the second set of arm-simulative members for providing additional resistance to the player in forcibly yieldable relationship when jumping to the shooting position.

4. A basketball training device according to claim 3, the second and third sets of arms being at heights for contacting the player's torso and arms respectively when jumping to the shooting position.

5. A basketball training device according to claim 1, the arm-simulative members each comprising a coil spring having an inner end secured to the edge framework, the coil spring extending axially along a substantial portion of the length of arm-simulative member, and padding material coaxially surrounding the coil spring, each coil spring inner end defining an axial extension, the cage framework being apertured for receiving such extension, and means for securing the extension within the respective aperture for such extension.

* * * * *